United States Patent [19]

Steinke

[11] 4,091,624

[45] May 30, 1978

[54] SELF-REGULATING FLUID CONTROL VALVE

[76] Inventor: Thomas J. Steinke, 494 Villa Ave., Fairfield, Conn. 06430

[21] Appl. No.: 717,337

[22] Filed: Aug. 26, 1976

[51] Int. Cl.[2] ..... E02B 7/40; E02B 7/52

[52] U.S. Cl. ..... 61/25; 61/22 R

[58] Field of Search ..... 61/17, 18, 22 A, 22 R, 61/25, 16, 23, 24, 28, 26; 137/448, 426, 427, 429, 428, 398, 236; 251/23, 302

[56] References Cited

U.S. PATENT DOCUMENTS

| | | | |
|---|---|---|---|
| 581,538 | 4/1897 | Dean | 61/25 |
| 616,486 | 12/1898 | McGown | 61/25 |
| 1,139,104 | 5/1915 | Collar | 61/26 |
| 3,208,225 | 9/1965 | Humpherys | 61/25 |
| 3,832,854 | 9/1974 | Metts | 61/17 X |
| 3,916,945 | 11/1975 | Bennett | 137/448 X |

*Primary Examiner*—Dennis L. Taylor
*Attorney, Agent, or Firm*—Wooster, Davis & Cifelli

[57] ABSTRACT

Self-regulating tide gates comprise a door pivotally mounted to the end of a conduit connecting two separated bodies of water. The door is held open to permit full reciprocal flow between a protected one of the bodies of water and the other body of water until the flow would cause an undesirably high water level in the protected body of water. A float senses the water level and releases the door, which then closes a cut off further flow of water. In some embodiments, the door is hingedly connected to the lower edge of the conduit, is buoyant, and is retained in its open position until the float releases it for self-closing. A latching mechanism is employed to hold the door open, or the weight of the float and its connecting float rod accomplish this purpose. In other embodiments, the door is pivotally hinged to the upper edge of the conduit and is provided with counterweights to maintain it in its open position. A float operates against the counterweight to release the door for closing. A stilling well comprising a vertical shaft intersecting the conduit connecting the two bodies of water provides an installation site for the self-regulating tide gates, and the water level in the stilling well follows the water level in the protected body of water during flow thereto. The float is also positioned in the stilling well to secure this level. A vacuum break conduit comprising an upwardly extending conduit intersecting the conduit connecting the two bodies of water adjacent the door provides an air passageway to the conduit which prevents formation of a vacuum behind the door upon closing, and thereby also prevents the damage to the door which would otherwise occur because of the formation of such a vacuum.

19 Claims, 18 Drawing Figures

55
57
50
37
51
36
35
47
56
33
34
54
53
20
48
32
31
38
42
45
44
41
40
46
10

55
57
50
37
51
36
56
34
53
33
40
32
39
31
10
20
47
35
48
46
41
38
44
45
42
43

31
10
39
60
64
62
68
66
65
63
61
67
41
53
33
34
36
37
51
50
55
56
57
47
48
20

31
10
39
32
38
40
45
42
43
46
41
53
33
34
36
37
51
50
57
56
55
47
35
48
20

55
56
57
10
20
120
121
125
126
127
128
129
130
131

SELF-REGULATING FLUID CONTROL VALVE

This invention relates to a self-regulating fluid control valve, and more particularly to a self-regulating tide gate which permits reciprocal flow through a conduit connecting two bodies of water but closes to cut off such flow upon conditions which would result in an undesirably high water level in one of the bodies of water.

Throughout the world there are situations where one body of water has been separated from another and subsequently a controlled flow of water between the two is desired. This isolation has been achieved on purpose or unintentionally through the use of barriers such as dikes, levees, causeways or dams. Often a barrier included a series of one or more conduits to allow communication between the two separated bodies for drainage purposes. Occasionally these conduits were fitted with valves or gates which were designed to control the head, volume, time or rate of flow from one body of water to the next. The prior art contains many instances whereby automatic controls have been designed to maintain: a constant head of water on the upstream side of the gate (Hale U.S. Pat. No. 2,616,266, Ponsar U.S. Pat. No. 2,645,089, and Harlburt U.S. Pat. No. 3,168,814); a constant or fixed volume of water flow in a fixed period of time before closing (Humpherys U.S. Pat. No. 3,208,225); a constant rate of flow with no time limit or upstream head requirement (Collar U.S. Pat. No. 1,139,104 and Lewin U.S. Pat. No. 2,904,963); or a constant or one-way direction of flow for tidal systems (Jacobs U.S. Pat. No. 3,733,830). Jacobs' patent includes illustrations of the most basic top hinged "flap valve". In every instance the control valve or gate is designed to allow water to pass in one direction only. Any water which passes through the valve is physically prevented from reversing its flow.

Yet, automatically controlled reciprocal flow from one body of water to another is desirable for at least one important application, namely restoring tidal action to diked-off areas of salt water marshes. Many of such marshes have been destroyed or severely damaged by diking which prevents salt water tidal flushing, although the diking has often been necessary to prevent the marshes from overflowing and flooding surrounding areas during extremely high tides, such as often occur during storms. Two-way or reciprocal flow controls are currently achieved for such areas through (1) manual operation of a relatively simple valve or gate and (2) automatic operation of a relatively complex gate system using electrical or mechanical means based on power sources external to the gate installation. In both cases, an inordinate financial expense is required to operate, acquire and/or maintain the gate system.

Conventional flap valves allowing one-way flow are rarely kept in an open position and are rarely closed after a significant flow of water has begun to pass the valve. This is because the valves and conduits are designed to sustain static loads from fixed heads of water, but they are not designed to stand up to the tremendous forces resulting from shock loading, i.e., standing water pressure against a closed valve is relatively small, but the water pressure resulting when a column of water approaching the mouth of the valve and passing therethrough is abruptly stopped by the valve's closing is very large. In instances where the valve is submerged and attached to the "upstream" end of a pipe conduit, closing of the valve will subject it to forces from its own weight, from the pressure of the approach column of water abruptly stopping, and most importantly but least expected, from the suction or vacuum pressure of the entire column of conduit water which is still moving away from the valve after it has closed. These forces have been overcome in the past through the use of hydraulic cushions between seating surfaces, hydraulic or pneumatic shock absorbers, inertia absorption through the use of massive valve gates and conduit frames that will absorb energy by their mass alone, and deflectors which turn the force of the rushing water back upon itself.

SUMMARY OF THE INVENTION

The self-regulating fluid control valves, also referred to as self-regulating tide gates, according to the invention herein provides reciprocal flow in a conduit connecting two bodies of water when open. The two bodies of water are usually a marsh and an ocean or estuary thereof. One of the bodies of water, usually a salt water marsh, is a "protected" body, i.e., the water level in the protected body of water is to be prevented from rising above a given critical level. The self-regulating tide gates automatically close upon the critical water level being attained in the protected body of water, thereby preventing the level in the protected body of water from rising above the critical level, and automatically reopen when the level in the unprotected body of water falls below the level in the protected body. Full reciprocal flow is then maintained until the critical level is achieved again in the protected body of water. No external power or attendant is required for operation of the self-regulating tide gate.

Several embodiments of self-regulating fluid control valves according to the invention herein are disclosed. All employ a door hingedly mounted to a conduit connecting two bodies of water and providing a passage for reciprocal flow of water therebetween, means for holding the door open to permit full reciprocal flow when the water level in the protected body of water is below a given critical level, and float means for sensing the water level and for releasing the means holding the door open when the critical water level is reached in the protected body of water. The hydraulic pressure or head of water acting on the door when the level in the unprotected body of water falls below the level in the protected body acts to open the door, and the mechanism for holding the door open automatically resets, with the result of full reciprocal flow being reestablished.

In some embodiments the door is buoyant and is hingedly connected to the bottom of the conduit mouth. The buoyant door is held open by a catch mechanism which is connected to and released by a float lifted by rising water level in some embodiments, and the buoyant door may be held open by the weight of the float and/or a float support rod acting directly on the door, wherein rising water removes this weight, in another embodiment.

In other embodiments, the door is hingedly connected to the top of the conduit and is provided with a counterweight for holding the door open. A float acts against the counterweight, permitting the door to close, when the critical water level is achieved in the protected body of water.

Other aspects of the invention herein include placing self-regulating tide gates in a stilling well, which consists of a vertical shaft or conduit intersecting the closed conduit connecting and permitting a reciprocal flow between the two bodies of water. The water level in the stilling well tracks the water level in the protected body during flow into the protected body, and the stilling well, therefore, permits the float of the self-regulating tide gate to be presented with the level of the water in the protected body and facilitates closing the self-regulating tide gate at the critical water level. The stilling well is particularly useful when small conduits are employed between the two bodies of water, small conduits not permitting sufficient flow for the water levels to remain equal despite the valve being open. The stilling well also provides a protected site for the self-regulating tide gate and access thereto for maintenance.

The self-regulating tide gates, as well as the conventional flapper gates, are provided with a vacuum break consisting of an upwardly extending air passageway intersecting the conduit adjacent to the gate. The vacuum break relieves the vacuum formed behind the door of the self-regulating, or other, tide gate by water rushing through the conduit.

OBJECTS OF THE INVENTION

Accordingly, the principal object of the invention is to provide a self-regulating tide gate permitting reciprocal flow in a conduit between two or more separated bodies of water with automatic closure of the conduit upon attainment of a given water level in a protected one of the bodies of water.

An additional object of the invention is to provide a self-regulating tide gate which achieves the foregoing object without reliance on manual operation or external power sources.

Another object of the invention is to provide a self-regulating tide gate which is economical to construct and maintain on existing or new conduit installations and is adaptable to closed or open top conduits such as round pipe, box culverts or canals.

A further object of the invention is to provide a self-regulating tide gate which is reliable and maintenance free, and in particular, does not clog from or malfunction because of debris.

Yet another object of the invention is to provide an enclosed installation for a self-regulating tide gate which presents the self-regulating tide gate with the water level in the protected body of water during periods of water flow to the protected body of water.

An additional object of the invention is to provide a self-regulating tide gate or other tide gate or relatively light construction but which does not self-destruct upon closing during conditions of high flow.

Other and more specific objects of the invention will in part be obvious and will in part appear from the following description of the preferred embodiments and the drawings.

DRAWINGS

The same reference numbers refer to the same elements throughout the various figures.

DESCRIPTION OF THE PREFERRED EMBODIMENTS

Figure 1:
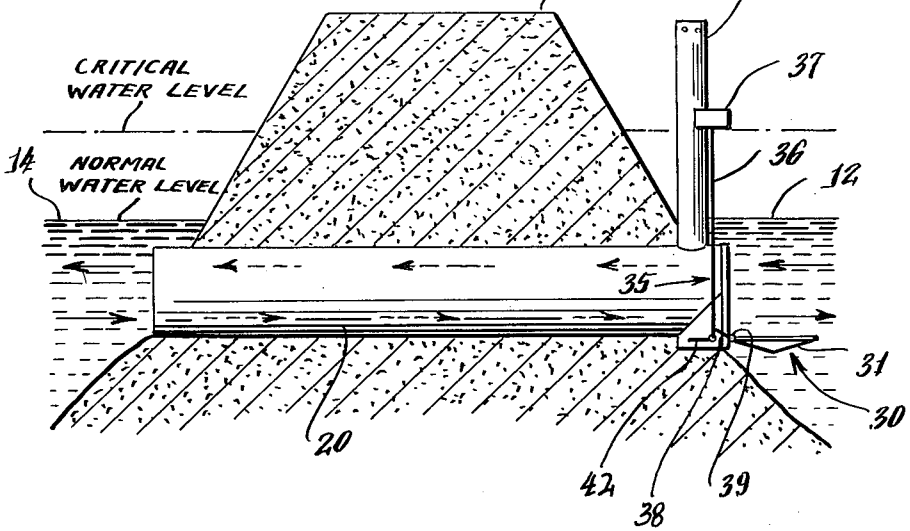
FIG. 1 is a side elevation view, partially in section, of a conduit installed through a dike separating a marsh and an ocean, with a self-regulating tide gate according to the invention herein installed on the conduit, the self-regulating tide gate being in its open condition permitting reciprocal flow between the marsh and ocean.

Referring first to FIGS. 1 - 4, they illustrate a self-regulating tide gate 30 according to the invention herein and its general operation which achieves the purposes of this invention.

A dike 10 separates a first body of water 12, which may be an ocean or other tidal body of water, from a second body of water 14, which may be a marsh or other impoundment. The dike 10 is fitted with a conduit 20 which, absent any water control valves or gates, would permit full reciprocal flow of water between the ocean 12 and marsh water 14. However, the dike 10 has the purpose of controlling ingress of water from the ocean 12 into the marsh 14 particularly when the ocean 12 achieves a very high water level which, if attained in the marsh, would cause flooding of surrounding areas. To this end, conduit 20 through the dike 10 has in the past been fitted with a prior art flap valve, similar to flap valve 148 shown in FIG. 14, which permits water to exit the marsh when the marsh water level exceeds the ocean water level, but prevents water from entering the marsh when the ocean water level exceeds the marsh water level. Such a flap valve precludes salt water flushing of the marsh and thereby destroys the salt water environment and accompanying ecological systems of the marsh, creating in its place a fresh water swamp, ideal for breeding mosquitoes and often quite dry with a high risk of grass fires.

Figure 3:
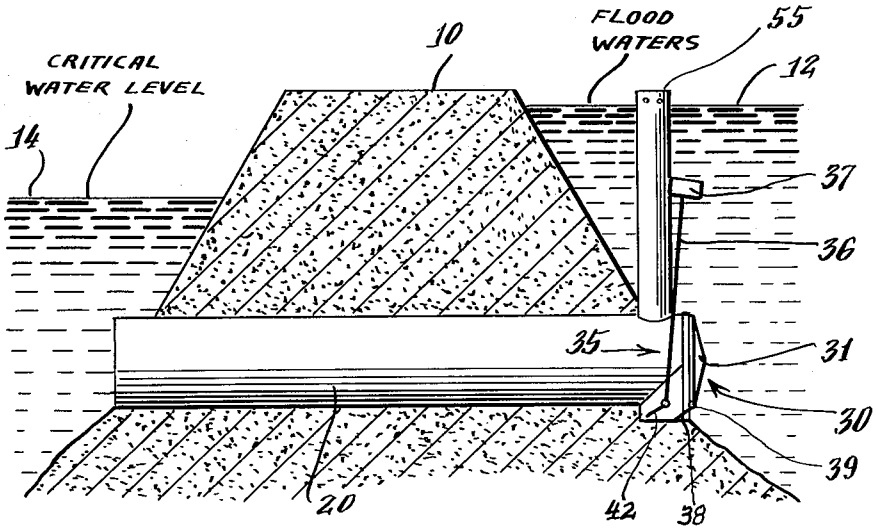
FIG. 3 is a side elevation view similar to FIGS. 1 and 2, showing the self-regulating tide gate closed and protecting the marsh from further ingress of water.

In FIG. 1, the conduit 20 is shown fitted with a self-regulating tide gate 30 constituting a first embodiment of the invention herein. The self-regulating tide gate 30 is generally comprised of a buoyant door 31 pivotally mounted to the conduit 20 along the lower edge thereof and pivotal from a first open position shown in FIG. 1 to a second closed position shown in FIG. 3. The self-regulating tide gate 30 further comprises a latch mechanism 35 including a float rod 36, and a float 37. The latch mechanism maintains the buoyant door 31 in its open position until a given water level, labeled the "critical water level", is attained in the marsh 14, at which time the water acts on the float to release the latch mechanism 35, permitting buoyant door 31 to close. Upon closing of the door 31, the conduit 20 is blocked and further ingress of water from the ocean to the marsh is prohibited. Thus, as illustrated in FIG. 3, the critical water level is maintained in the marsh 14 despite water in the ocean 12 reaching a level which, if attained in the marsh 14, would cause flooding of surrounding areas.

Figure 4:
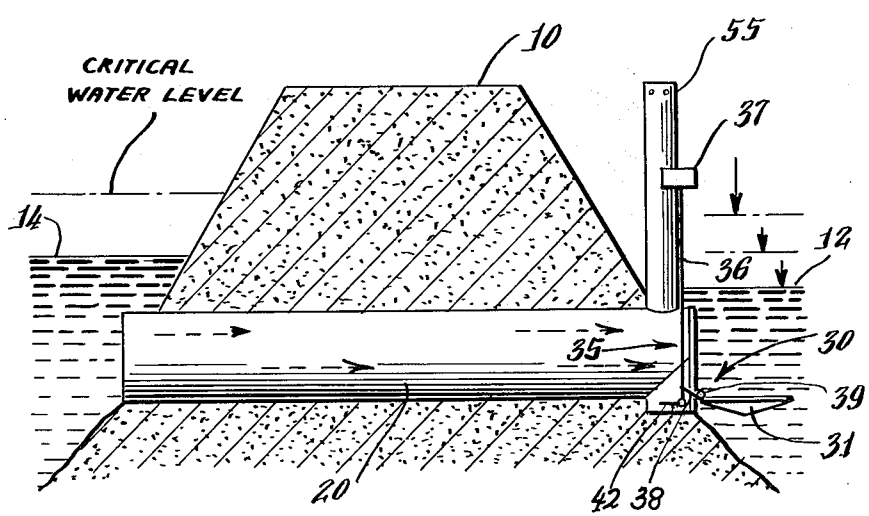
FIG. 4 is a side elevation view similar to FIGS. 1 - 3, showing the self-regulating tide gate open.

Referring now to FIG. 4, when the water level in the ocean 12 recedes below the critical water level in the marsh 14, the hydraulic head of water in the marsh 14 causes door 31 to open and the rush of water through the conduit pushes it down to its fully open position resetting the latch mechanism and restoring full reciprocal flow of water between the ocean 12 and marsh 14. Thus, full reciprocal flow between the ocean 12 and marsh 14 is achieved except under conditions which would cause flooding in the marsh, at which time the self-regulating tide gate 30 operates to prevent flooding.

Figure 6:
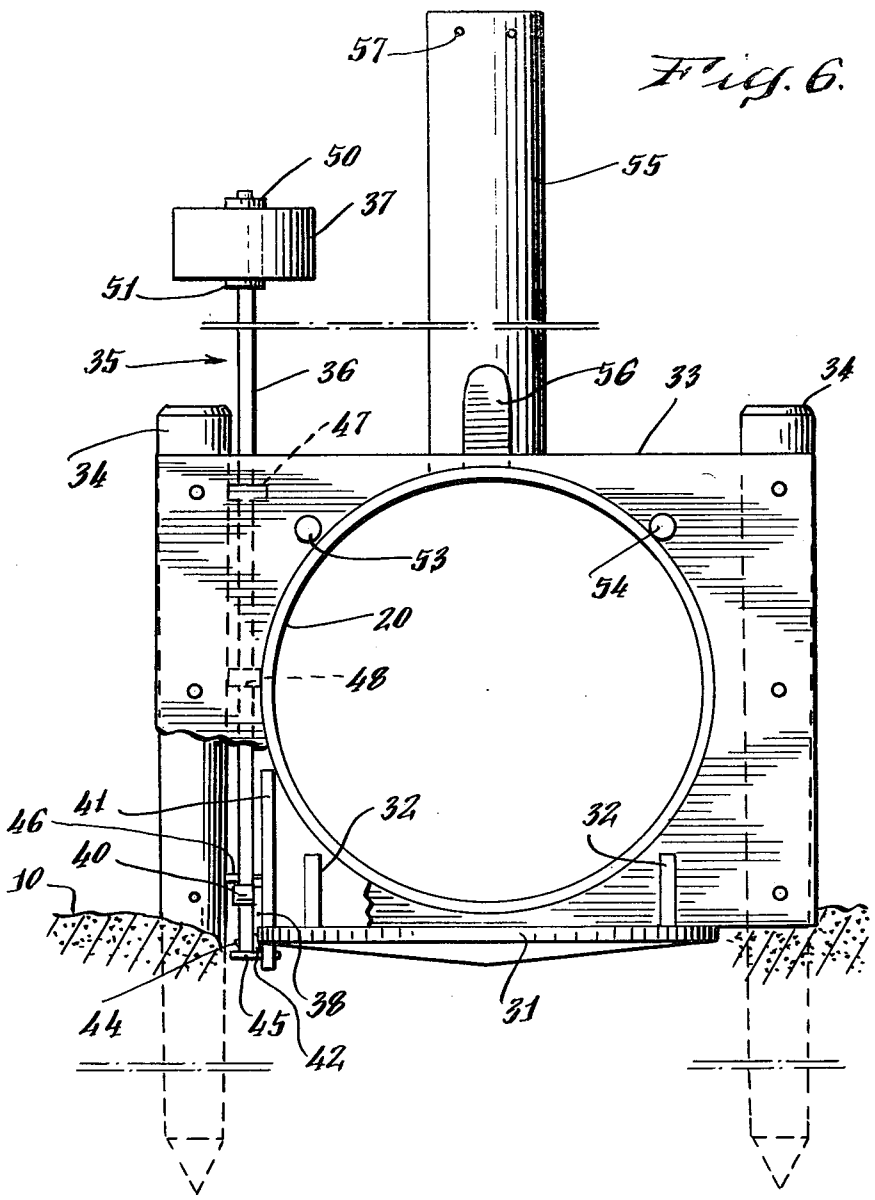
FIG. 6 is a front elevation view of the self-regulating tide gate of FIG. 5.
Figure 5:
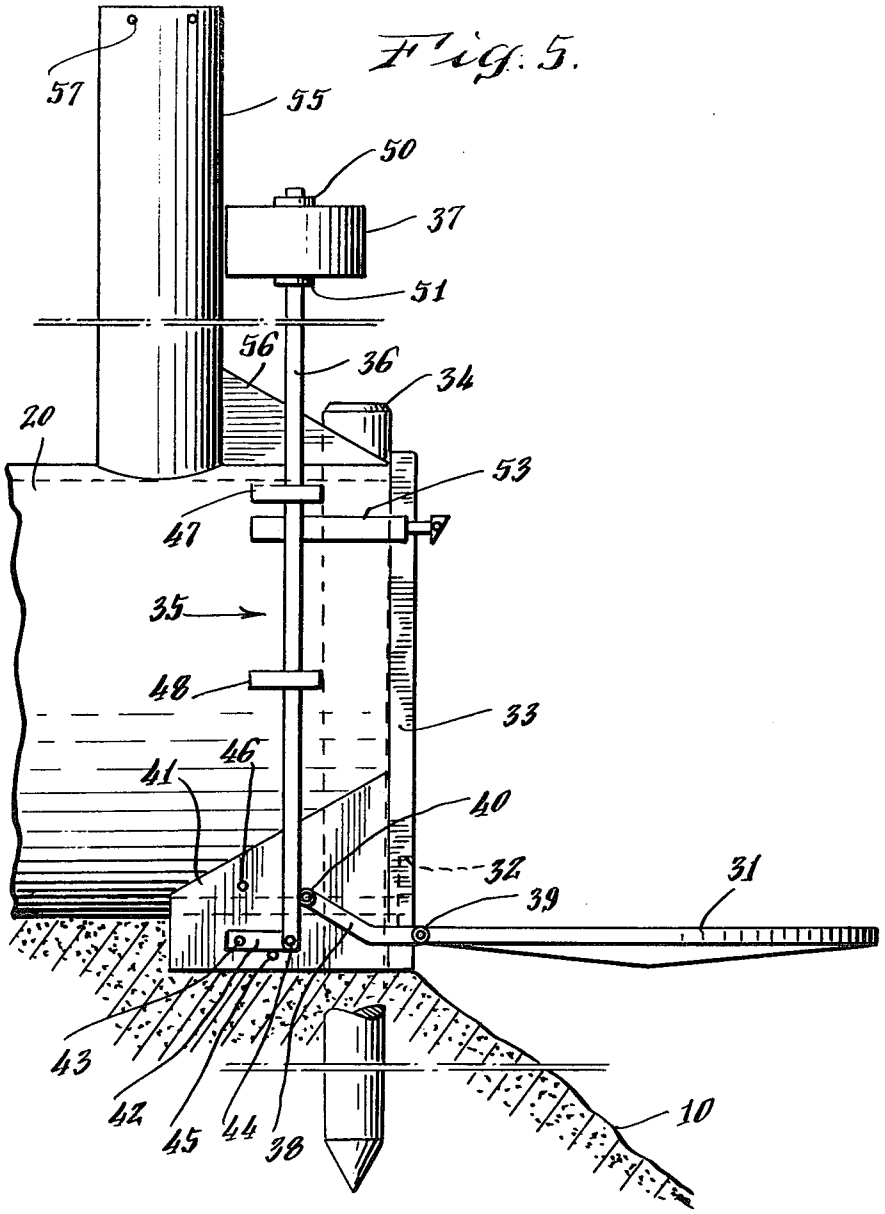
FIG. 5 is a side elevation view of a self-regulating tide gate according to the invention herein (also shown in FIGS. 1 - 4) in its open position.
Figure 7:
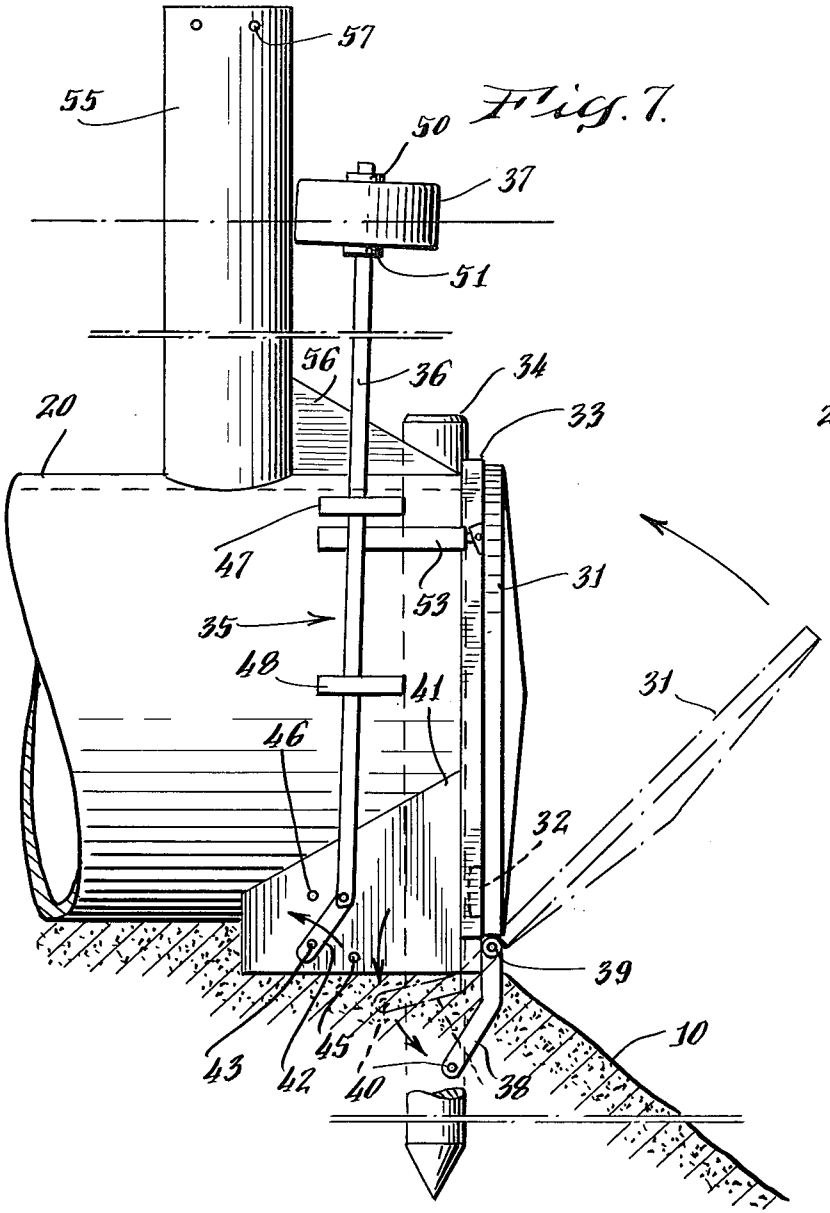
FIG. 7 is a side elevation view of the self-regulating tide gate of FIG. 5 in its closed position.

Referring now to FIGS. 5 – 7, the self-regulating tide gate 30 constituting a first embodiment of the invention herein is shown in more detail. The door 31 is hingedly connected by hinges 32 to a plate 33, which is mounted to the end of conduit 20. The plate 33 includes a central opening aligned with the opening of conduit 20, and the door 31 is hingedly mounted such that it pivots between the open position shown in FIGS. 5 – 6 and the closed position shown in FIG. 7. The door 31 blocks the end opening of conduit 20 when it is in its closed position. The plate 33 may also be secured to a pair of posts 34 which are driven into the dike 10 to provide additional anchorage and support for the conduit 20 and self-regulating tide gate 30.

Figure 15:
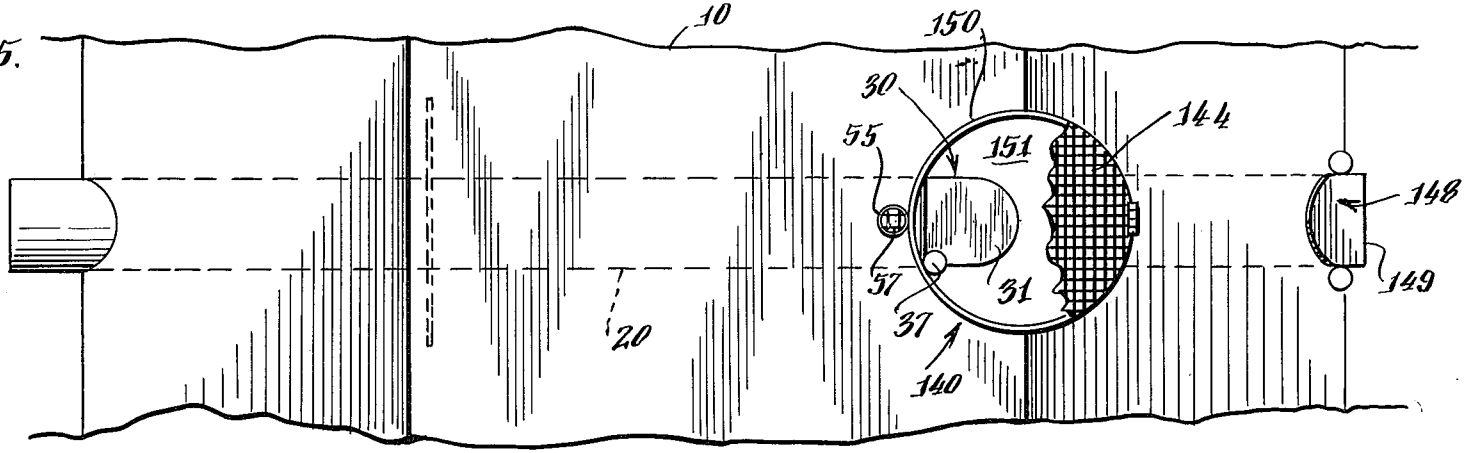
FIG. 15 is a top view of a conduit connecting a marsh and an ocean through a dike, a stilling well intersecting the conduit, and the self-regulating tide gate of FIG. 5 installed in the stilling well, all according to the invention herein.

The door 31 is buoyant, being constructed of wood, a metal honeycomb, or of fiberglass, plastic, or metal with buoyant material such as closed cell foam attached thereto. Thus, when the door 31 is submerged in water, it has a tendency to pivot upward toward its closed position, as indicated in FIG. 7. The door 31 may be of a U-shape when viewed in plan, as best seen in FIG. 15 illustrating the self-regulating tide gate 30 in a stilling well installation described below. The outer surface of door 31 is preferably provided with a conical configuration, as shown, or other deflecting configuration such as parabolic.

A door tongue 38 is connected to the door 31 and extends under plate 33 from the pivot axis 39 of the hinges 32, and thereafter upwardly at a slight angle. A horizontally disposed roller 40 extends outwardly from the end of the door tongue 38 and engages the float rod 36, thereby maintaining the door in its open position. A bracket 41 extends rearwardly from the plate 33 and provides a mounting point for a connecting link 42. One end of the connecting link 42 is pivotally mounted to the bracket 41 as indicated at 43, and the other end of the connecting link 42 is pivotally mounted to the lower end of float rod 36 as indicated at 44. Two pin stops 45 and 46 are provided to maintain the angle between the connecting link 42 and the float rod 36 between approximately 90° and 180°.

The float rod 36 is loosely embraced and maintained substantially vertical by two U-shaped brackets 47 and 48 which may be conveniently mounted to the post 34. The float 37 surrounds the float rod 36 and is positioned thereon by two collars 50 and 51, which are preferably movable to adjust the position of the float 37 on the float rod 36. Shock absorbers 53 and 54 are mounted to the plate 33 to absorb some of the force attendant with the closing of door 31. The self-regulating tide gate 30 is also provided with a vacuum break conduit 55, which will be more fully described below.

Referring now to FIG. 1, during conditions of normal water levels the door 31 of self-regulating tide gate 30 is maintained in an open position permitting full reciprocal flow through conduit 20 between the ocean 12 and the marsh 14. The buoyancy of door 31 would cause door 31 to close upon submersion, but the engagement between the roller 40 attached to the door tongue 38 and the float rod 36 maintains the door 31 in its open position.

Figure 2:
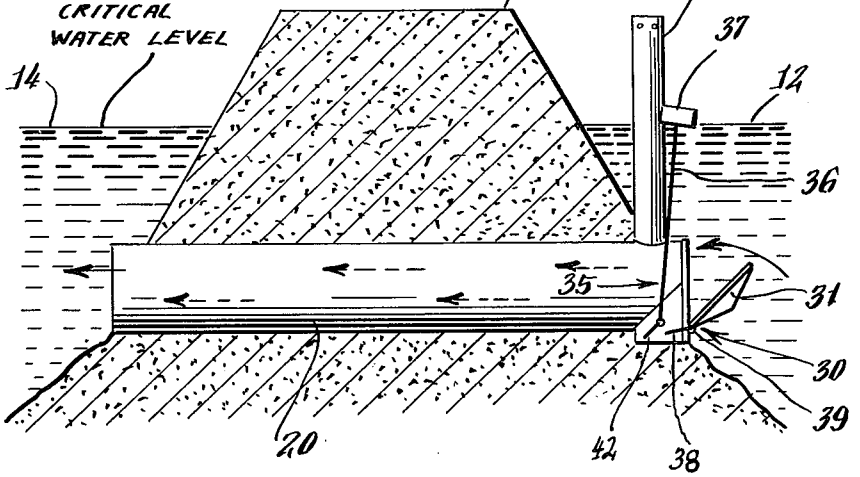
FIG. 2 is a side elevation view similar to FIG. 1, wherein a critical water level is attained in the marsh and the ocean, and the self-regulating tide gate is closing.

Referring now to FIGS. 2 and 7, when the critical water level is attained, the water acts on float 37 which lifts float rod 36 and pivots the connecting link 42 upwardly from pin stop 45 toward pin stop 46. The float rod 36 thus moves away from plate 33, releasing door tongue 38 and permitting the buoyant door 31 to rise and close. Water rushing toward the open end of conduit 20 at the time door 31 closes tends to slam the door 31 closed and part of the impact of the door closing against the plate 33 and the conduit 20 is absorbed by the shock absorbers 53 and 54. The conical or other deflecting surface of door 31 is also helpful in reducing the shock load on the door, as is the vacuum break described below.

As the water in ocean 12 rises above the water level in marsh 14, as illustrated in FIG. 3, the hydraulic head of the ocean water maintains the door 31 in closed position, preventing flow through conduit 20.

Referring now to FIG. 4, when the water level in ocean 12 falls below the water level in marsh 14, the hydraulic head of the marsh water 14 causes the door 31 to pivot to its open position. The float 37 no longer supports the float rod 36 in the position shown in FIG. 7 and the float rod 36 and connecting link 42 fall back to the position shown in FIG. 5. The engagement between roller 40 of door tongue 38 and the float rod 36 is reestablished, holding the door 31 open until the cycle is repeated. In many instances, the float 37 and float rod 36 fall back to the position shown in FIG. 5 before the door 31 opens. When the door 31 opens shortly thereafter, the horizontally disposed roller 40 engages the underside of connecting link 42 and pushes it and the float 37 and float rod 36 upwardly as the door 31 pivots to the open position. The float rod 36 then drops in behind the roller 40 to latch the door 31 in its open position.

Figure 8:
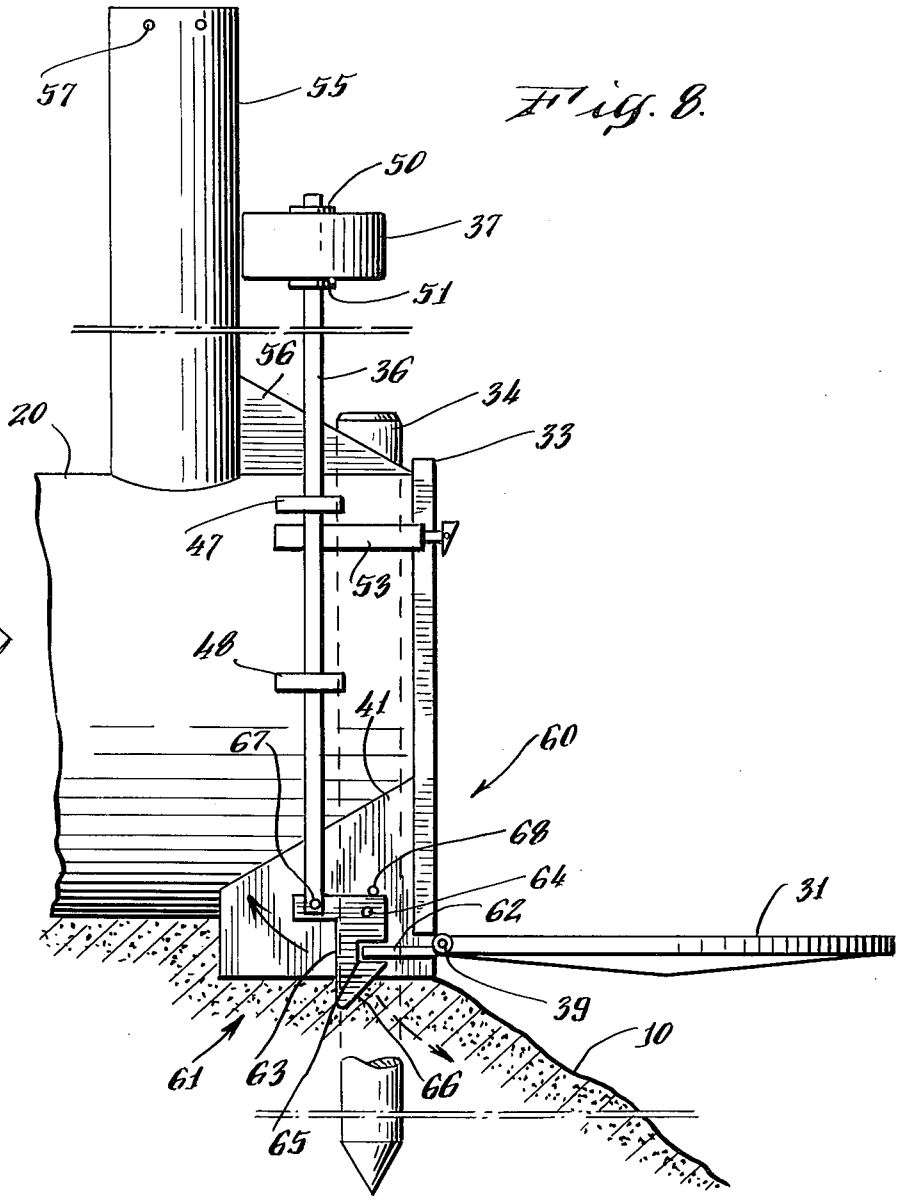
FIG. 8 is a side elevation view of another self-regulating tide gate according to the invention herein.

A self-regulating tide gate 60, which is a second embodiment of the invention herein, is shown in FIG. 8. It also generally comprises a buoyant door 31 hingedly connected to a plate 33 mounted to the end of conduit 20. Other parts of the self-regulating tide gate 60, such as the posts 34, float rod 36, float 37, hinges 32 and hinge pivot axis 39, bracket 41, float rod brackets 47 and 48, float clamps 50 and 51, shock absorbers 53 and 54 and vacuum break conduit 55 are similar to those described above with respect to self-regulating tide gate 30. Door 31 is provided with a straight door tongue 62 which extends beyond the hinge pivot axis 39 to the area behind plate 33.

Self-regulating tide gate 60 is provided with a latch mechanism 61 which includes a latch plate 63 pivotally mounted to the bracket 41 by pin 64. The latch plate 63 includes a notch 65 which receives a door tongue 62 when the door 31 is in its open position illustrated in FIG. 8. Immediately below the notch 65 is a beveled edge 66 of the latch plate 63, which will be more fully described below. The bottom end of the float rod 36 is pivotally attached to the latch plate 63 by a pin indicated at 67. A stop pin 68 is provided to hold latch plate 63 against any upward pressure exerted by door tongue 39 in notch 65, such as occurs when the door 31 is not submerged.

Operation of the self-regulating tide gate 60 is similar to that of the self-regulating tide gate 30 described above. When the critical water level is achieved, the float 37 lifts the float rod 36 and pivots the latch plate 63 about pin 64, causing disengagement of the door tongue 62 from notch 65. The door 31, being buoyant, then pivots to its closed position blocking conduit 20. When the water level recedes, the float rod 36 drops and returns the latch plate 63 to the position shown in FIG. 8. When door 31 opens, the end of door tongue 62 engages the beveled edge 66 of the latch plate 63 and briefly rotates the latch plate 63 until door tongue 62 seats in the notch 65, thereby holding the door 31 in its open position until such time as the critical water level is next attained.

Figure 11:
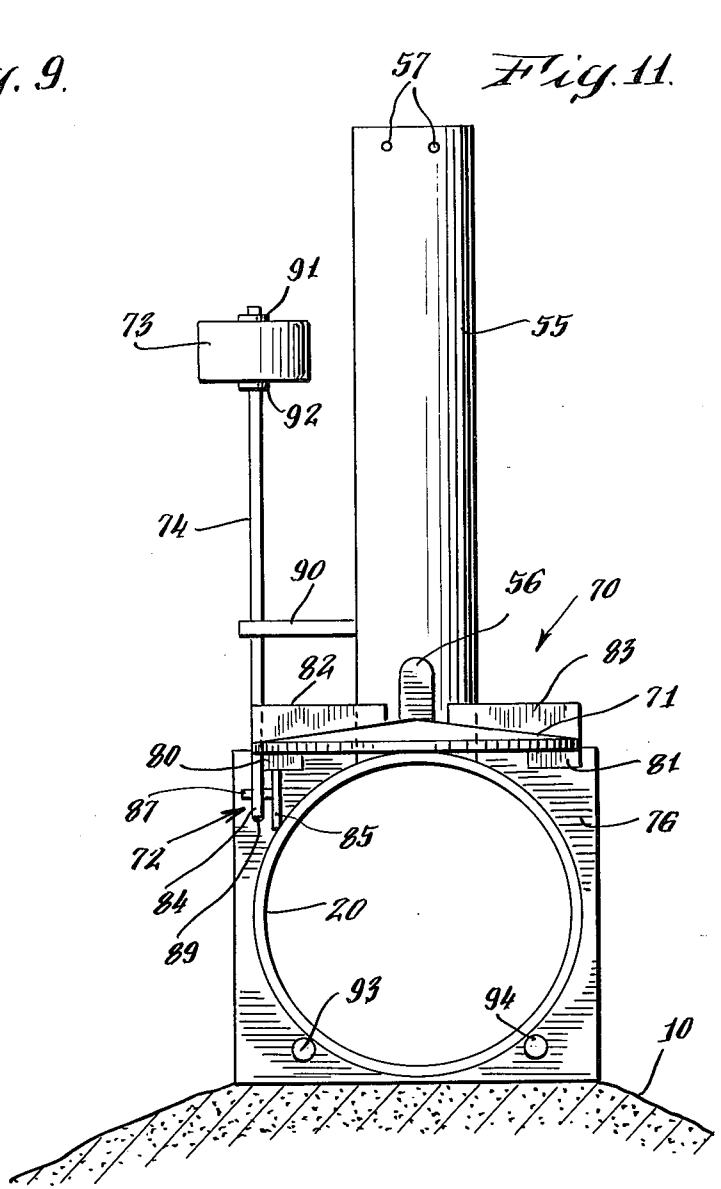
FIG. 11 is a front elevation view of the self-regulating tide gate of FIG. 9.
Figure 9:
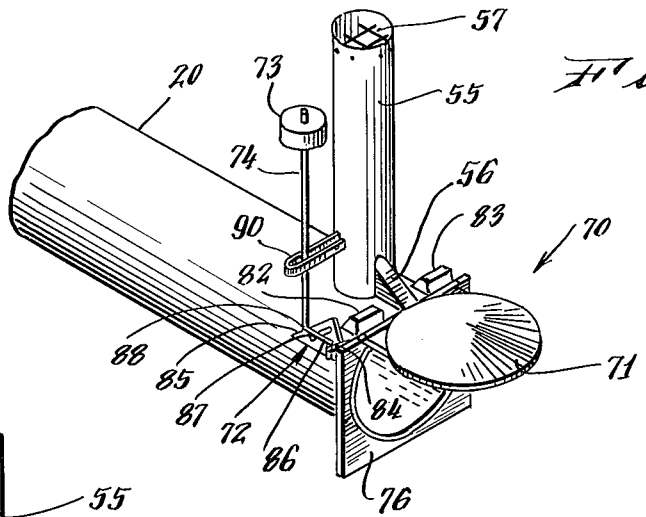
FIG. 9 is a perspective view of another self-regulating tide gate according to the invention herein.
Figure 10:
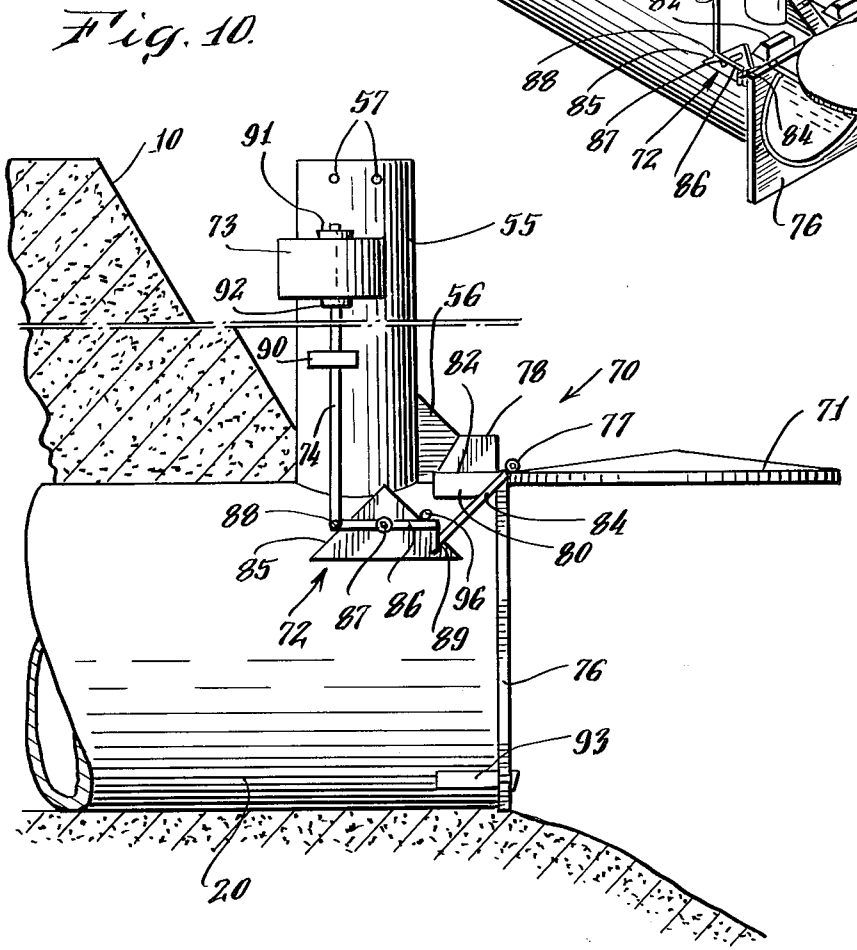
FIG. 10 is a side elevation view of the self-regulating tide gate of FIG. 9.

A self-regulating tide gate 70, which is a third embodiment of the invention herein, is shown in FIGS. 9 – 11. It generally comprises a door 71 which is pivotally mounted at the end of conduit 20 and pivotable between the open position shown in FIGS. 9 and 11 and a closed position (not shown) blocking the mouth of conduit 20, a latch mechanism 72 for holding the door 71 in its open position until the critical water level is attained, and a float 73 and float rod 74 which release the latch mechanism 72 when the critical water level is reached. The self-regulating tide gate 70 is different from the self-regulating tide gates described above in that the door 71 is hingedly connected to the conduit along the upper portion thereof.

More particularly, the self-regulating tide gate 70 includes a rectangular plate 76 which is secured to the mouth of conduit 20. The rectangular plate has formed therethrough a circular opening exposing the mouth of the conduit, as shown. The door 71 is pivotally mounted to the top of the rectangular plate 76 by hinges such that the door pivots around an axis generally indicated at 77. The door 71 includes a portion 78 which extends across the top of plate 76, and attached to the portion 78 are a pair of counterweights 80 and 81, a pair of buoyant pontoon floats 82 and 83, which are preferably of adjustable buoyancy. A door tongue 84 extends from the pivot axis of the door 71 toward the latch mechanism 72.

The latch mechanism 72 includes a mounting plate 85, which is shown mounted to the conduit 20 but which may also extend from the rectangular plate 76. A latching arm 86 is pivotally mounted to the bracket or plate 85 at a generally central pivot pin 87. The float rod 74 is pivotally connected to one end of the latching arm 86, as indicated at 88. When the door 71 is in its open position, the other end of the latching arm 86 engages the end of the door tongue 84, as indicated at 89. A stop pin 96 protrudes from plate 85 and secures the latching arm against rotation in the counterclock-wise direction as viewed in FIG. 10. The float rod 74 is maintained in a generally upright position by a bracket 90 which is mounted to an upstanding vacuum break conduit 55 which intersects the conduit 20 adjacent the self-regulating tide gate 70. The float 73 is held and positioned on the float rod 74 via two mounting collars 91 and 92.

The two counterweights 81 and 80 maintain the door 71 in its open position until the water level rises above the door 71, at which time the lifting force of the buoyant pontoon floats 82 and 83 counteract the counterweights 80 and 81. However, at this time the door 71 is still maintained in its open position by the engagement at 89 of door tongue 84 against the latching arm 86 of the latch mechanism 72. When the water level reaches its critical level, it acts on the float 73 which lifts one end of the latching arm 86 and the float rod 74, thereby pivoting the latching arm 86 and releasing the engagement indicated at 89 between the latching arm 86 and the door tongue 84. This permits the door to close and prevents further ingress of water through the conduit 20. The plate 76 is provided with two shock absorbers 93 and 94 which absorb the force of the door as it closes.

As the water recedes, the float 73 and float rod 74 drop and return the latching arm 86 to the latching position shown in FIGS. 9 – 11. The hydraulic head of water in the marsh side created when the ocean water recedes causes the door 71 to open and, assisted by the counterweights 80 and 81, the door 71 pivots to its full open position whereupon the latching engagement indicated at 89 between the latching arm 86 and the door tongue 84 is reestablished. The door tongue 84 briefly rotates the latching arm 86 in order to establish latching. Thus, the door 71 is reset in its open position until the next critical water level occurs.

Figures 12, 13, 14:
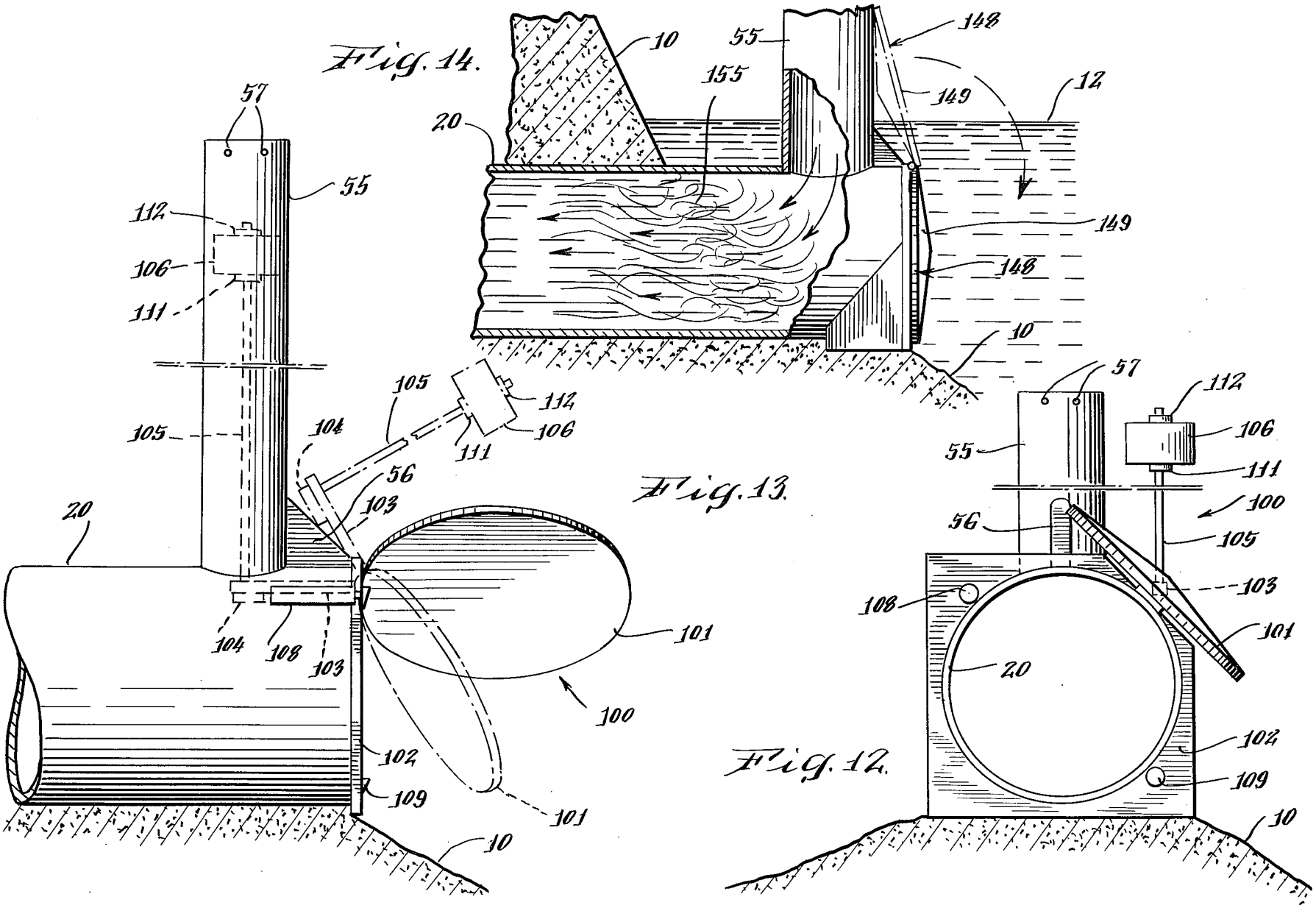
FIG. 12 is a front elevation view of another self-regulating tide gate according to the invention herein.
FIG. 13 is a side elevation view of the self-regulating tide gate of FIG. 12.
FIG. 14 is a side elevation view of a conventional flap valve installed on a conduit and including a vacuum break according to the invention herein and modified according to the invention herein.

Another self-regulating tide gate 100 according to the invention herein is illustrated in FIGS. 12 and 13. It generally comprises a door 101 which is pivotally mounted to a plate 102 secured to the end of conduit 20. The door includes a rearwardly extending portion 103, which is across the pivot axis from the main portion of the door which covers the mouth of the conduit 20 when the door is in its closed position. A counterweight 104 is attached to the portion 103 of door 101, and an upstanding float rod 105 and float 106 are also attached to the rearwardly extending portion 103 of door 101. The float 105 is held on float rod 106 by two collars 111 and 112. The door is shown mounted to the plate 103 at approximately 45 degrees from vertical, which does not interfere with the door 101 pivoting between the open position shown in FIGS. 12 and 13 and a closed position covering the mouth of conduit 20. Debris will not collect on the angle-mounted door, and it also offsets the float 106 and float rod 105 from the center of the conduit 20 to thereby clear an upstanding vacuum break conduit 55.

The door 101 is maintained in its open position by counterweight 104 until such time as the critical water level is achieved. The water then acts on float 106, which lifts against the counterweight 104, causing the door 101 to close. The float rod 105 is disposed horizontally when the door 101 is closed, but the float 106 is relatively small, and is sufficiently small that it alone will not cause the door to open by lever action through float rod 105. Shock absorbers 108 and 109 are mounted to the plate 102 to ease the shock loads created when the door closes.

The door is opened by water flow from the marsh to the ocean 12 through conduit 20, which occurs when the water level in the ocean recedes below the water level in the marsh. The flow of water through conduit 20 opens door 101 sufficiently far for the counterweight 104 to act to hold the door 101 in its open position. This embodiment of the invention has the advantage of not requiring any active latch mechanism to maintain the door in its open position.

Figures 17, 18:
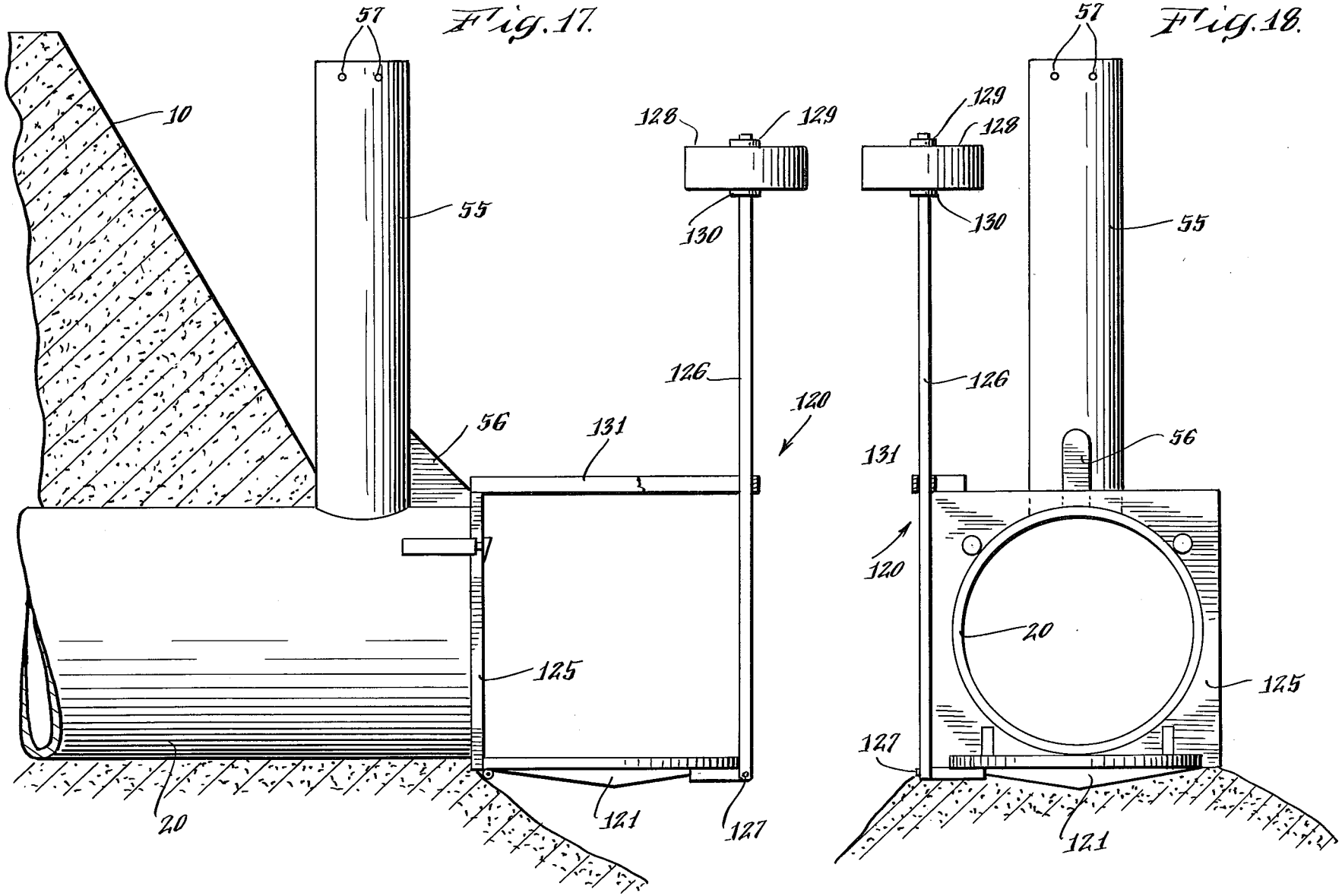
FIG. 17 is a side elevation view of another self-regulating tide gate according to the invention herein.
FIG. 18 is a front elevation view of the self-regulating tide gate of FIG. 17.

An additional self-regulating tide gate 120 according to the invention herein is shown in FIGS. 17 and 18. It generally comprises a door 121 hingedly mounted to a plate 125 which is secured to the end of conduit 20. The plate 125 includes an opening coincident with the mouth of conduit 20. The door 121 is hingedly mounted to the bottom of plate 125 and is pivotable between the position shown in FIGS. 17 and 18 and a closed position blocking the mouth of conduit 20. A float rod 126 is pivotally attached to the outer end or top of the door 121 by a hinge 127, and a float 128 is adjustably positioned on the float rod 126 by collars 129 and 130. A bracket 131, including a longitudinal slot extending along its length and through which the float rod 126 passes, serves to guide the float rod 126 and maintain it in generally vertical position out of the path of water and any debris carried by the water flowing through conduit 20.

The door 121 is slightly buoyant, and may be wood, a honeycomb metal construction, or may be fiberglass or metal with flotation provided. When the water is below the critical level, the door 121 is maintained in its open position by the weight of the float 128 and/or float rod 126. However, when the water reaches the critical level and acts on float 128, the weight of the float 128 and float rod 126 is removed from the door 121. The door 121, being buoyant, will then begin to pivot toward its closed position, and is caught in the current of water entering conduit 20, which acts to quickly move the door 121 to its closed position blocking the mouth of conduit 20 and preventing further passage of water therethrough to the marsh. When the water level on the ocean side recedes below the level of the water impounded in the marsh, the hydraulic head of water acts to reopen the door 121, and it is thereafter held open by the weight of the float 128 and float rod 126 until the critical water level is next achieved.

It will be understood that although the self-regulating tide gate 30 is shown in FIGS. 1 - 4 illustrating the operation of the self-regulating tide gates according to the invention herein, any of the other embodiments of the self-regulating tide gates described can be substituted for or operate in the same manner. It will also be understood that the self-regulating tide gates can be adapted to conduits of any size, and can be adapted to conduits of other shapes instead of the round conduit 20 illustrated. Although an earthen dike 10 is illustrated, the conduit 10 may be placed through a concrete dike, or any other barrier, such as a retaining wall, bulkhead, or other similar structure. In addition, the "bottom hinged" self-regulating tide gates, such as self-regulating tide gates 30 and 60 and 120 can be installed on open topped conduits, such as canals, provided the door is of sufficient size to restrain water levels above the critical water level from passing through the canal. This is particularly advantageous in providing access for boats to enter marsh areas during periods when the self-regulating tide gate door is open.

The self-regulating tide gates described above are installed so that the doors thereof pivot to their closed position with the flow of water into the protected body of water. This is conveniently achieved by installing the self-regulating tide gates on the "ocean" end of conduit 20. The flow of water toward the mouth of the conduit 20 assists in closing the doors and the hydraulic head created when the waters on the ocean side rise above the water on the marsh side maintains the doors in their closed position. Also, the doors are opened by the hydraulic head created when the waters on the ocean side recede below the water on the marsh side of the dike. Because the self-regulating tide gates are positioned on the ocean side of the dike, the floats operate to close the doors of the self-regulating tide gates when the critical water level is achieved in or on the ocean side of the dike, although the critical water level in the marsh side of the dike is the desired level for closing the doors.

In those instances where there are a sufficient number of conduits, or where the conduits are of a sufficient size, the water level on the ocean and marsh sides of the dike will be approximately the same while the self-regulating tide gates are open. Under those circumstances, the critical water level in the marsh is attained at approximately the same time as the critical water level is attained on the ocean side of the dike and the float positioned on the ocean side of the dike will operate the self-regulating tide gate at the proper water level. However, when an insufficient number and/or size of conduits are deployed through the dike, the water level in the marsh may lag behind that of the ocean during periods of inflow of water to the marsh from the ocean. Fast build up of water on the ocean side aggravates the problem. Thus, the self-regulating tide gate may be prematurely closed. Some compensation may be made by adjusting the floats to a higher position on the float rods, but doing so could also result in late closing of the self-regulating tide gate door.

Figure 16:
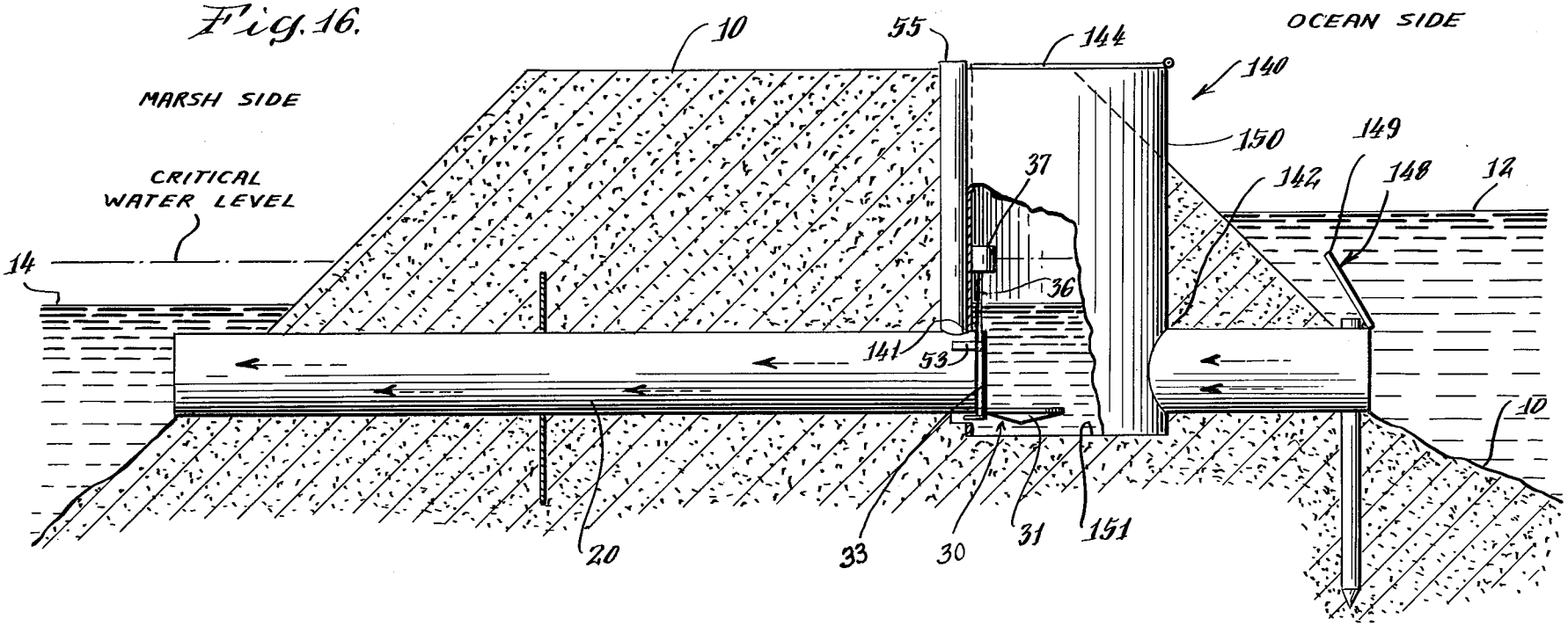
FIG. 16 is a side elevation view of the conduit, stilling well and self-regulating tide gate of FIG. 15.

The preferred solution to this problem is illustrated in FIGS. 15 and 16. A stilling well 140, comprising a vertical cylindrical (or other shaped) shaft 150 similar to a well or manhole, intersects the conduit 20 at 141 and 142. The stilling well shaft 150 extends from a bottom 151 disposed below conduit 20 upwardly to above the top of dike 10. Thus, water flowing through conduit 20 passes through the shaft 150 of the stilling well 140.

Self-regulating tide gate 30 including its door 31, float 37 and float rod 36, is installed on the portion of conduit 20 leading from the stilling well 140 to the marsh 14. Other embodiments of self-regulating tide gates disclosed herein may also be installed instead of self-regulating tide gate 30.

During inflow of water into the marsh from the ocean, the water level in the stilling well 140 closely follows the water level in the marsh, despite any higher water level being attained in the ocean, as illustrated in FIG. 16. Thus, when the critical water level is reached in the marsh, the same water level is extant in the stilling well 140 and the self-regulating tide gate 30 closes in the manner described above. Immediately thereafter the water level in the stilling well equalizes with the water level in ocean 12, providing the hydraulic head which maintains the door 31 of self-regulating tide gate 30 in its closed position. The water level in the stilling well 140 also recedes with the water level in the ocean, such that the self-regulating tide gate 30 opens as also described above.

The stilling well 140 is preferably covered with a grate 144 which may be provided with locking means, thereby enclosing the self-regulating dike gate 35 and shielding it from vandals and/or debris. The stilling well 140 also provides a convenient service access to the self-regulating tide gate 30. To assist in this regard, the end of conduit 20 opening to the ocean side may be fitted with a conventional prior art manually operable gravity flap valve 148. The flap valve 148 may be manually closed during periods of low water level, and will thereafter operate to keep water out of the conduit 20 and stilling well 140, maintaining the self-regulating tide gate 30 fully exposed for inspection, service, or repair.

In each of the installations of self-regulating tide gates described above, there has been included a vacuum break conduit 55 according to the invention herein which is vertically disposed and intersects conduit 20 adjacent the opening thereof on to which the door of the self-regulating tide gate closes. A triangular conduit extension 56 is preferably provided to extend the conduit 55 to a point very close to the plate on which the doors of the self-regulating tide gates are mounted. The vacuum break conduit 55 extends upwardly from conduit 20, terminating above the dike 10. A grate 57 is preferably placed at the top of the conduit to keep debris out. Vacuum break conduits according to the invention herein are also advantageously employed with other submerged closing valves, and a vacuum break conduit 55 is shown in FIG. 14 attached to a conduit 20 on to which a top hinged prior art gravity flap valve 148 including door 149 is mounted.

The vacuum break conduit 55 is very helpful in alleviating stress and shock loads on a door when it closes in a moving flow of water. Referring particularly to FIG. 14, without a vacuum break conduit, water moving through conduit 20 when flap valve 148 closes continues to move through conduit 20, thereby drawing a vacuum behind the closed door 149. The presence of such a vacuum causes the door to slam shut with great force, and can result in the door being broken and pushed into the conduit. Extremely heavy construction of the door and its associated mounting parts has been resorted to, along with large shock absorbers and the like, to offset this problem.

The vacuum break conduit 55 prevents the formation of a vacuum behind the door by providing an air passageway into that area. In operation, a large volume of air is drawn into the conduit 20 after the door 149 closes. The water in the conduit 20 becomes extremely agitated and foamy as it mixes with this air and dissipates its energy upon itself, and the flow through conduit 20 is gently converted to a static condition. This is illustrated in FIG. 14. Operation of the vacuum break conduit 55 is similar when installed in conjunction with the various embodiments of self-regulating tide gates. When vacuum break conduit 55 is used, the door and associated mounting structures can be of lighter construction, and the shock absorbers can be of substantially reduced capacity, if required at all.

It should also be noted that a further reduction in loading upon the door can be achieved by selecting the configuration of the outer surface of the door such that it disperses water, and in particular such that it disperses the flow of water established toward the door just prior to its closing. A conical outer surface is illustrated in the Figures of this application for this purpose. Shock absorbers are still desirable to ease the impact of the door closing, but these shock absorbers may be of smaller size than was necessary without the vacuum break conduit and dispersing door configurations.

The self-regulating tide gates disclosed herein are advantageously used to restore tidal flushing of salt water marshes, and are well adapted for this purpose. The doors of the self-regulating tide gates are self-closing, and the tide gates are self-regulating to permit full reciprocal flow and tidal flushing until the water level in the marsh reaches a level at which it is desired to cut off further flow thereto, at which time the doors automatically self-close. The doors also automatically reopen to restore full reciprocal flow and tidal flushing, and remain open until the next "maximum" water level is attained in the marsh. Once the float is set to release the door for closing at the proper level, no further attendance to the self-regulating tide gates is required.

The self-regulating tide gates are also susceptible of other uses as water or other fluid control valves. Such other uses include installation through levees or dikes to control flow of irrigation water to farm land, and in other situations wherein it is desired to have full reciprocal flow of water between two bodies of water until a given level in one of the bodies of water is reached. Additionally, two such self-regulating fluid control valves can be attached to opposite ends of the conduit connecting two bodies of fluid to provide differential fluid flow control capability.

It will also be understood that features of some of the structures described can be utilized in others, e.g. the angled door of self-regulating tide gate 100 is applicable to other self-regulating tide gates, both top and bottom hinged, if desired. Also, features of particular latching mechanisms disclosed are in some instances interchangeable, and other latching mechanisms can be substituted to accomplish the described operation. The self-regulating tide gates can also be mounted intermediate a conduit, provided the float is exposed to open water for tripping. The advantages of the vacuum break conduit and stilling well features are also applicable to other situations then self-regulating tide gates. These and other departures from the detailed description herein can be made without departing from the spirit and scope of the invention.

I claim:

1. A self-regulating water control valve for installation on a generally horizontally disposed conduit connecting two bodies of water separated by a barrier wherein it is desired to permit reciprocal flow of water through the conduit connecting the two bodies of water while the water level in a protected one of the bodies remains below a given critical water level and to prohibit flow of water from the other body of water through the conduit to the protected body of water when the continued flow of water would elevate the water level in the protected body of water above the critical water level, the self-regulating water control valve comprising:

A. a self-closing door hingedly mounted to the conduit connecting the two bodies of water about a pivot axis and pivotable between an open position permitting reciprocal flow of water through the conduit and a closed position blocking flow of water to the protected body of water from the other body of water;

B. means releaseably holding the door in its open position upon its being pivoted to its open position; and C. a float connected to the means releaseably holding the door in its open position and releasing said means upon being lifted, the float positioned to be lifted and to release said means when continued flow of water would elevate the water level in the protected body of water above the critical water level, whereby when the float releases the means releaseably holding the door in its open position, the door pivots to its closed position blocking further flow of water through the conduit to the protected body of water, and when the water level in the other body of water recedes below the water level in the protected body of water, the door is pivoted to its open position by the hydraulic head extant between the protected body of water and other body of water and by the flow of water through the conduit which occurs as the door opens.

2. A self-regulating water control valve as defined in claim 1 wherein the door is hingedly mounted to the lower edge of the conduit and is buoyant, whereby the door is self-closing and in particular pivots from its open position to its closed position upon being released because of its buoyancy.

3. A self-regulating water control valve as defined in claim 2 wherein said means releaseably holding the door in its open position comprises a door tongue connected to said door and projecting oppositely therefrom across the pivotal mounting axis thereof, and a latching mechanism engageable with said door tongue.

4. A self-regulating water control valve as defined in claim 3 wherein said latching mechanism comprises a float rod and a connecting link, said float rod generally vertically disposed adjacent the end of said door tongue, one end of said connecting link pivotally connected to the lower end of the float rod and the other end of the connecting link pivotally connected to a fixed point spaced apart from the end of the door tongue, wherein when the connecting link is disposed toward the door tongue it positions the float rod for engaging the door tongue and holding the door open, and wherein the float is attached to the float rod and lifts the float rod and pivots the connecting link to remove the float rod from its position for engaging against the door tongue, thereby permitting the door to close.

5. A self-regulating water control valve as defined in claim 4 and further comprising a roller pivotally mounted to the end of said door tongue and positioned to engage said float rod, the roller minimizing friction between said float rod and said door tongue.

6. A self-regulating water control valve as defined in claim 4 and further comprising two stop pins positioned to limit the angle between said connecting link and said float to between 90° and 180°.

7. A self-regulating water control valve as defined in claim 3 wherein said latching mechanism comprises a latching plate pivotally mounted at a point spaced apart from the end of said door tongue, a portion of said latching plate extending toward the end of said door tongue from the pivot point and defining a notch receiving the door tongue to hold the door in its open position, and a portion of said latching plate extending from the pivot away from the door tongue and pivotally connected to the lower end of the float rod, wherein the float is attached to the float rod and lifts the float rod and thereby pivots the latching plate to release the door tongue, permitting the door to close.

8. A self-regulating water control valve as defined in claim 7 wherein the latching plate defines a beveled surface adjacent the notch thereof, the beveled surface disposed for slidingly engaging the door tongue as the door pivots to its open position, and rotating the latching plate to present the notch thereof to the door tongue so that the door tongue is received therein.

9. A self-regulating water control valve as defined in claim 2 wherein said means releaseably holding the door in its open position comprises a nonbuoyant float rod pivotally connected at its lower end to the door at a point spaced apart from the pivot mounting axis and the float is attached to the float rod, whereby the weight of said float rod and float acts against the buoyancy of the door to hold it open when the water level is below the float, and the float lifts the weight of the float and float rod from the door, thereby releasing the door and permitting it to close.

10. A self-regulating water control valve as defined in claim 1 wherein said door is hingedly mounted to the upper edge of the conduit and includes a portion extending beyond the pivot axis of the door, and further comprising:

D. at least one counterweight mounted to the portion of the door extending beyond the pivot axis, the counterweight being of sufficient weight for holding the door in its open position;

E. a float rod connected to the portion of the door extending beyond the pivot mounting axis, the float attached to the float rod, whereby the float lifts the counterweight, thereby permitting the door to close.

11. A self-regulating water control valve as defined in claim 1 wherein said door is hingedly mounted to the upper edge of the conduit and includes a portion extending beyond the pivot axis of the door, and further comprising:

D. at least one counterweight mounted to the portion of the door extending beyond the pivot axis, the counterweight being of sufficient weight to hold the door in its open position;

E. at least one pontoon float attached to the portion of the door extending beyond the pivot axis;

F. a door tongue attached to the door and extending therefrom;

G. a latching mechanism for engaging said door tongue when the door is in its open position and holding it in its open position; and H. a float rod attached to said latching mechanism and releasing its engagement with the door tongue upon being lifted, the float being attached to said float rod;

whereby water rising past the pontoon float causes it to act against the counterweight and would thereby permit the door to close except for the door tongue engaged by the latching mechanism, and water rising to the float lifts it and the float rod, thereby releasing the latching mechanism and permitting the door to close.

12. A self-regulating water control valve as defined in claim 1 and further comprising a stilling well, said stilling well comprising a vertically disposed shaft extending from a bottom thereof positioned below the conduit to above the barrier separating the two bodies of water, a portion of the conduit connecting the two bodies of the water opening into the shaft and extending therefrom to the protected body of water and another portion of the conduit opening into the shaft and extending therefrom to the other body of water, the portions of the conduit having substantially equal flow capacity wherein the door of said self-regulating water control valve is hingedly mounted within the shaft to the end of the conduit leading from the shaft to the protected body of water and the float is positioned within the shaft, whereby during flow of water to the protected body of water from the other body of water the water level in the shaft is substantially the same as the level of water in the protected body of water such that the given critical water level is attained in the protected body of water and shaft at substantially the same time, and said float is acted upon to release the means holding the door open at the critical water level, thereby releasing the means releaseably holding the door open and permitting the door to close.

13. A self-regulating water control valve as defined in claim 1 and further comprising a vacuum break conduit intersecting the conduit connecting the two bodies of water adjacent the door pivotally mounted thereto on the portion of the conduit leading to the protected body of water, the vacuum break conduit leading from the conduit connecting the two bodies of water to the air above the barrier separating the two bodies of water, whereby when the door closes the vacuum break conduit permits air to enter the conduit connecting the two bodies of water immediately adjacent the closed door.

14. A self-regulating water control valve as defined in claim 13 wherein the vacuum break conduit intersects the conduit connecting the two bodies of water at the top thereof.

15. A self-regulating water control valve as defined in claim 1 and further comprising at least one shock absorber mounted to said conduit and disposed for engaging the door on closing and absorbing the shock thereof.

16. A self-regulating water control valve as defined in claim 1 wherein said door has a conical water-dispersant surface disposed away from the protected body of water when the door is in its closed position.

17. A self-regulating tide gate for installation on a conduit connecting two bodies of water separated by a barrier, the self-regulating tide gate comprising:

A. a buoyant door;

B. means pivotally mounting the buoyant door to the conduit with a pivot axis lying along one edge of the door and the lower edge of the conduit, the door pivotable between a first generally horizontal open position and a second generally vertical closed position blocking the the flow of water through the conduit;

C. a door tongue attached to and extending from the buoyant door across the pivot axis thereof, the door tongue adjacent the conduit when the door is in its horizontal open position;

D. a connecting link, one end of said connecting link pivotally mounted to the conduit, the connecting link pivotal from a horizontal open position extending toward said door tongue when the door is in its horizontal open position to a vertical closed position;

E. a float rod, the lower end of the float rod pivotally mounted to the other end of said connecting link, the float rod disposed generally vertically and engaging the door tongue to hold the door open when the connecting link is in its horizontal position and the door is in its horizontal open position, and said float rod not engaging said door tongue when the connecting link is pivoted to its vertical position;

F. a float attached to the upper end of said float rod, the float pivoting said connecting link from its horizontal to its vertical position when said float is lifted by water, thereby releasing the door for closing.

18. A self-regulating tide gate as defined in claim 17 and further comprising a vacuum break conduit intersecting the conduit connecting the two bodies of water adjacent the door when the door is in its closed position, said vacuum break conduit extending vertically above the barrier separating the two bodies of water and providing an air passageway to the conduit connecting the two bodies of water.

19. An improvement in water control valves of the type comprising a door pivotally mounted to the input end of a generally horizontal water conduit leading out of a body of water, the door releasably held in a first open position permitting flow through the water conduit, and upon being released, freely pivotal to a second closed position blocking flow through the water conduit, wherein when there exists full and swift flow through the water conduit and the door is released, the freely pivotal transition of the door from its open to its closed position is rapid and a column of water continues to move through the water conduit after the door has closed thereby drawing a vacuum behind the door and subjecting the door to a large and potentially damaging pressure differential, the improvement comprising a vacuum break conduit intersecting said water conduit closely adjacent the door and extending above any water level extant above the water conduit to open atmosphere, said vacuum break conduit admitting air to the water conduit and preventing formation of a vacuum behind the door upon freely pivotal closing of the door during flow conditions through the water conduit which would otherwise create such a vacuum, thereby protecting the door from being subjected to large and potentially damaging pressure differentials.

* * * * *